US011100837B2

(12) United States Patent
Shan

(10) Patent No.: US 11,100,837 B2
(45) Date of Patent: Aug. 24, 2021

(54) METHOD FOR DRIVING DISPLAY PANEL, AND DRIVER FOR DISPLAY DEVICE

(71) Applicant: HKC Corporation Limited, Shenzen (CN)

(72) Inventor: Jianfeng Shan, Shenzen (CN)

(73) Assignee: HKC CORPORATION LIMITED, Shenzen (CN)

( * ) Notice: Subject to any disclaimer, the term of this patent is extended or adjusted under 35 U.S.C. 154(b) by 0 days.

(21) Appl. No.: 16/754,646

(22) PCT Filed: Nov. 9, 2017

(86) PCT No.: PCT/CN2017/110219
§ 371 (c)(1),
(2) Date: Apr. 8, 2020

(87) PCT Pub. No.: WO2019/071697
PCT Pub. Date: Apr. 18, 2019

(65) Prior Publication Data

US 2020/0357323 A1 Nov. 12, 2020

(30) Foreign Application Priority Data

Oct. 10, 2017 (CN) ..... 201710937013.5

(51) Int. Cl.
*G09G 3/20* (2006.01)

(52) U.S. Cl.
CPC ... *G09G 3/2003* (2013.01); *G09G 2310/0264* (2013.01); *G09G 2320/0233* (2013.01); *G09G 2360/16* (2013.01)

(58) Field of Classification Search
CPC ... G09G 2310/0264; G09G 2320/0233; G09G 2320/028; G09G 2360/16; G09G 3/2003; G09G 3/36
See application file for complete search history.

(56) References Cited

U.S. PATENT DOCUMENTS

2009/0079674 A1* 3/2009 Yoshiga ..... G09G 3/3648 345/60
2010/0007639 A1* 1/2010 Jeong ..... G09G 3/2007 345/208

(Continued)

FOREIGN PATENT DOCUMENTS

CN 101281705 A 10/2008
CN 101645235 A 2/2010

(Continued)

OTHER PUBLICATIONS

International Search Report issued for the corresponding international application No. PCT/CN2017/110219, dated Jul. 20, 2018, 10 pages.

*Primary Examiner* — Kenneth Bukowski
(74) *Attorney, Agent, or Firm* — Snyder, Clark, Lesch & Chung, LLP

(57) ABSTRACT

The present disclosure illustrates a driving method of a display panel, and a display device using the same. The driving method includes: adjusting a magnitude of a drive signal of each sub-pixels on the display panel such that the magnitude of the adjusted drive signals gets closer to a preset interval, wherein within the preset interval, slope each of tangent lines on a curve defining variation of luminance with respect to the drive signal is higher than a preset slope threshold; and using the adjusted drive corresponding one of signals to drive the sub-pixels.

18 Claims, 10 Drawing Sheets

(56) References Cited

U.S. PATENT DOCUMENTS

| | | | | |
|---|---|---|---|---|
| 2012/0281174 | A1* | 11/2012 | Yeh | G02F 1/1337 349/129 |
| 2015/0154929 | A1* | 6/2015 | Li | G09G 3/3611 345/212 |
| 2016/0232842 | A1 | 8/2016 | Imai et al. | |

FOREIGN PATENT DOCUMENTS

| | | | |
|---|---|---|---|
| CN | 102819993 | A | 12/2012 |
| CN | 104751817 | A | 7/2015 |
| CN | 105761679 | A | 7/2016 |
| JP | 2000003155 | A | 1/2000 |

* cited by examiner

METHOD FOR DRIVING DISPLAY PANEL, AND DRIVER FOR DISPLAY DEVICE

CROSS-REFERENCE TO RELATED APPLICATION

This application is a national stage application that claims the benefit of International Application No. PCT/CN2017/110219, filed Nov. 9, 2017, which claims the benefit of China Patent Application No. 201710937013.5, filed on Oct. 10, 2017, in the State Intellectual Property Office of the People's Republic of China, the disclosures of which are incorporated herein in their entirety by reference.

BACKGROUND

1. Field

The present disclosure generally relates to a display technology, more particularly to a driving method of a display panel and a display device using the same.

2. Description of the Related Art

Large-size liquid crystal display panels usually apply negative Vertical Alignment (VA) liquid crystal technology or In-Plane Switching (IPS) liquid crystal technology. Compared with the IPS liquid crystal technology, VA liquid crystal technology has advantages in higher production efficiency and low manufacturing cost, but has worse optical property, particularly, in business application in which a larger view angle is required.

In larger view angle, tendency of brightness saturation of sub-pixels in the VA liquid crystal display panel quickly increases, that is, the curve tends to become flat. Particularly, when being driven by the middle or low drive voltage, brightness saturation occurs quickly, contrast of display decreases, so washout effect significantly occurs on the panel when being viewed under mixed view angles, that is, the screen image becomes whiter, and brightness of panel cannot linearly vary according to the drive voltage.

SUMMARY

The present disclosure is to provide a driving method of a display panel, and a display device using the same.

According to an embodiment, the present disclosure provides a driving method of the display panel. The driving method includes: adjusting a magnitude of a drive signal of each sub-pixels on the display panel such that the magnitude of the adjusted drive signals gets closer to a preset interval, wherein within the preset interval, slope of each tangent lines on a curve defining variation of luminance with respect to the drive signal is higher than a preset slope threshold; and using the adjusted drive signals to drive corresponding one of the sub-pixels.

According to an embodiment, the present disclosure provides a display device which includes a display panel and a driver chip. The driver chip is configured to adjust a magnitude of a drive signal of each sub-pixels on the display panel, such that the magnitude of the adjusted drive signals gets closer to a preset interval, and use the adjusted drive signals to drive the sub-pixels on the display panel. Within the preset interval, a slope of each of tangent lines on a curve defining variation of luminance with respect to the drive signal is higher than a preset slope threshold.

According to an embodiment, the present disclosure provides a driving method of display panel. The driving method includes: according to the curve defining variation of luminance with respect to the drive signal under a side view angle of the display panel, when the drive signal is lower than a first threshold, higher than a second threshold, or between the first threshold and the second threshold, respectively, the slope of tangent line on the curve defining variation of luminance with respect to the drive signal is higher than a preset slope threshold, higher than the preset slope threshold, or lower than the preset slope threshold; separating the sub-pixels having the same color into multiple sub-pixel sets on the display panel; calculating an average drive signal of each sub-pixel set; decreasing the drive signal, which is higher than the average drive signal, by a first preset value when it is determined that the average drive signal is lower than the first threshold; when it is determined that the average drive signal is higher than the first threshold and lower than the second threshold, increasing the drive signal, which is higher than the average drive signal, by a third preset value; when it is determined that the average drive signal is higher than the second threshold, decreasing the drive signal, which is higher than the average drive signal, by a fifth preset value; using the adjusted drive signals to drive corresponding one of the sub-pixels.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
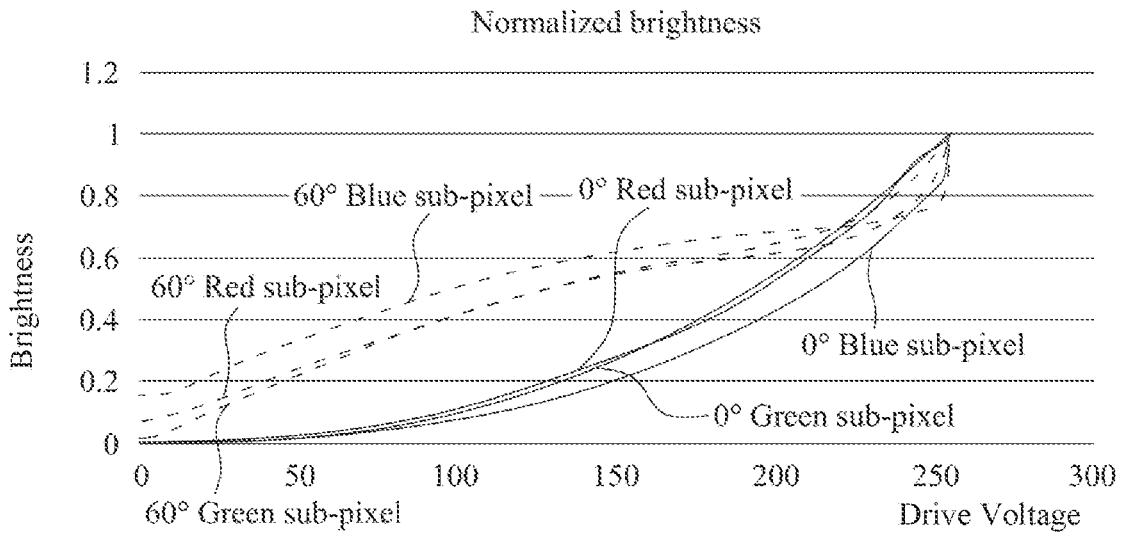
FIG. 1 shows brightness-versus-drive-voltage curves of sub-pixel under 0 degree of view angle and 60 degrees of view angle.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

FIG. 1 shows a brightness brightness-versus-drive-voltage curve of the VA liquid crystal display panel. In FIG. 1, the horizontal axis is drive voltage, and the longitudinal axis is brightness, the solid line is curve corresponding to 0 degree of side view angle, and the dashed line is curve of 60 degrees of side view angle. As shown in FIG. 1, tendency of brightness saturation of each sub-pixel under 60 degrees of side view angle quickly increases, that is, curve tends to flat. Particularly, under the middle or low drive voltage, brightness saturation occurs quickly and brightness contrast between pixels decreases, so that washout effect significantly occurs on the panel when being viewed under mixed view angles; that is, the screen image becomes whiter and brightness of pixel cannot linearly vary according to the drive voltage.

In order to overcome the washout effect, an embodiment of the present disclosure provides a driving method of a display panel. The driving method can be executed by a driver chip, and the drive chip can be configured to drive the display panel to display an image. The display panel can be, but not limited to, Twisted Nematic (TN) type liquid crystal display panel, Optically Compensated Birefringence (OCB) type liquid crystal display panel, the VA type liquid crystal display panel, curved liquid crystal display panel, or the like.

Figure 2:
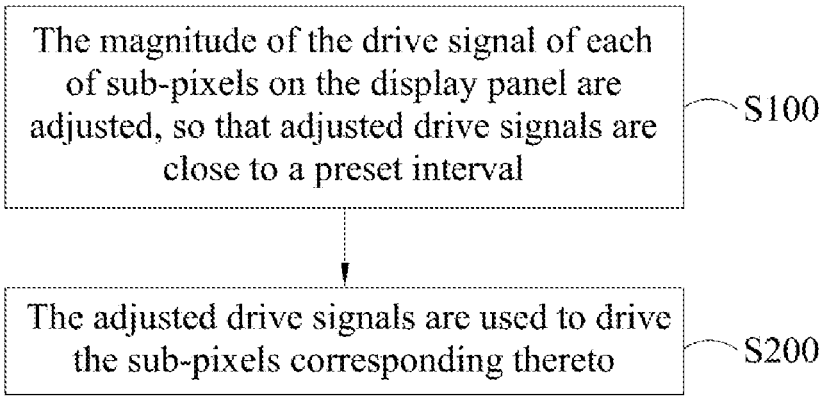
FIG. 2 is a flowchart showing the steps in an operation of a driving method of a display panel of an embodiment of the present disclosure.

Please refer to FIG. 2. The driving method of the display panel may include steps S100 and S200.

In the step S100, the magnitude of the drive signal of each sub-pixels on the display panel are adjusted, so that adjusted drive signals are close to a preset interval. Within the preset interval, the slope of each of tangent lines on the luminance-versus-signal curve is higher than the preset slope threshold.

For example, the drive signal can be a drive voltage provided by the driver chip to the display panel. The sub-pixel can be a red sub-pixel, a green sub-pixel or a blue sub-pixel. Within the preset interval, the slope of each tangent line on the luminance-versus-signal curve is higher than the preset slope threshold, and it indicates that the curve corresponding in position to the preset interval has a larger slope, so that the brightness can be significantly varied along with the drive voltage and more linearly. For this reason, in the step S100, the magnitudes of the drive signals within the interval where the curve is flatter (that is, the brightness is almost saturated) can be adjusted, so that the adjusted drive signals can be close to the interval where the slope of the curve is higher, thereby preventing brightness saturation.

In the step S200, the adjusted drive signals are used to drive the sub-pixels corresponding thereto.

The driver chip can input the adjusted drive signals to the display panel, to drive corresponding sub-pixels to display image.

In the driving method of the display panel of the embodiment, by optimizing distribution of the drive signals, the drive signals of the sub-pixels can be adjusted to the interval where the brightness may be just saturated slightly or not be saturated, and variation tendency of the brightness-versus-drive-signal curve can be more linear, thereby effectively preventing the washout effect when the display panel is viewed under the large view angle.

In an embodiment, on the curve defining variation of luminance with respect to the drive signal under a condition that the display panel is viewed by the side view, when drive signal is lower than the first threshold, higher than the second threshold, or between the first threshold and the second threshold, respectively, the slope of the tangent line is higher than the preset slope threshold, higher than the preset slope threshold, or lower than the preset slope threshold.

Figure 7:
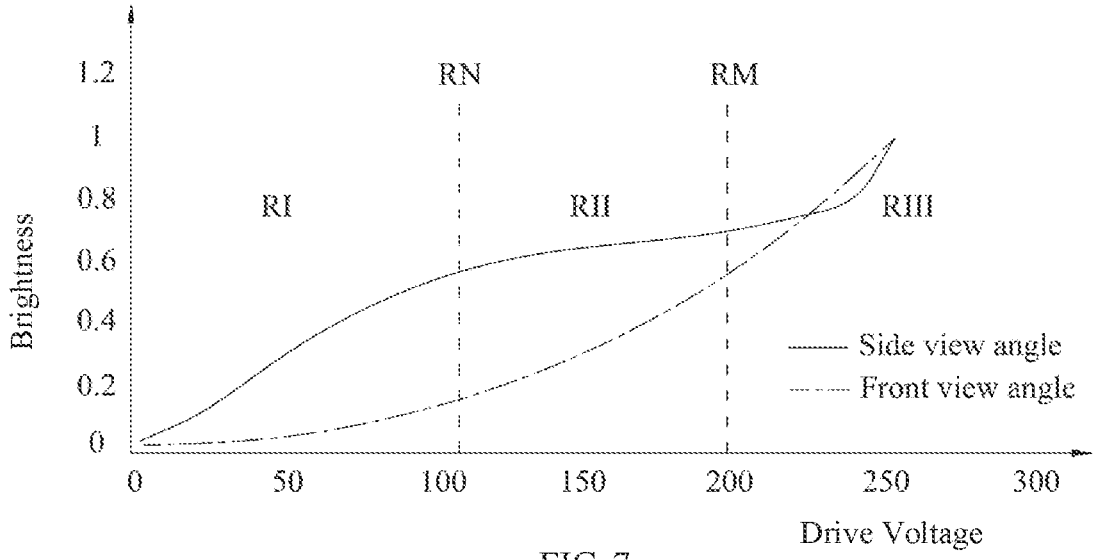
FIG. 7 shows brightness-versus-drive-signal curves of the red sub-pixel of the display panel, in accordance with the present disclosure.
Figure 8:
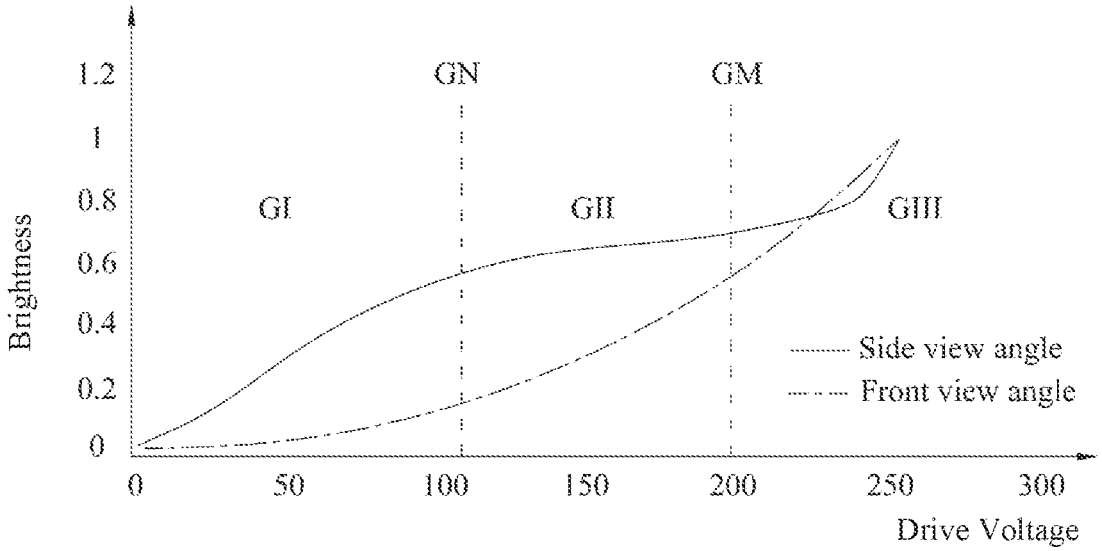
FIG. 8 shows brightness-versus-drive-signal curves of a green sub-pixel of the display panel, in accordance with the present disclosure.
Figure 9:
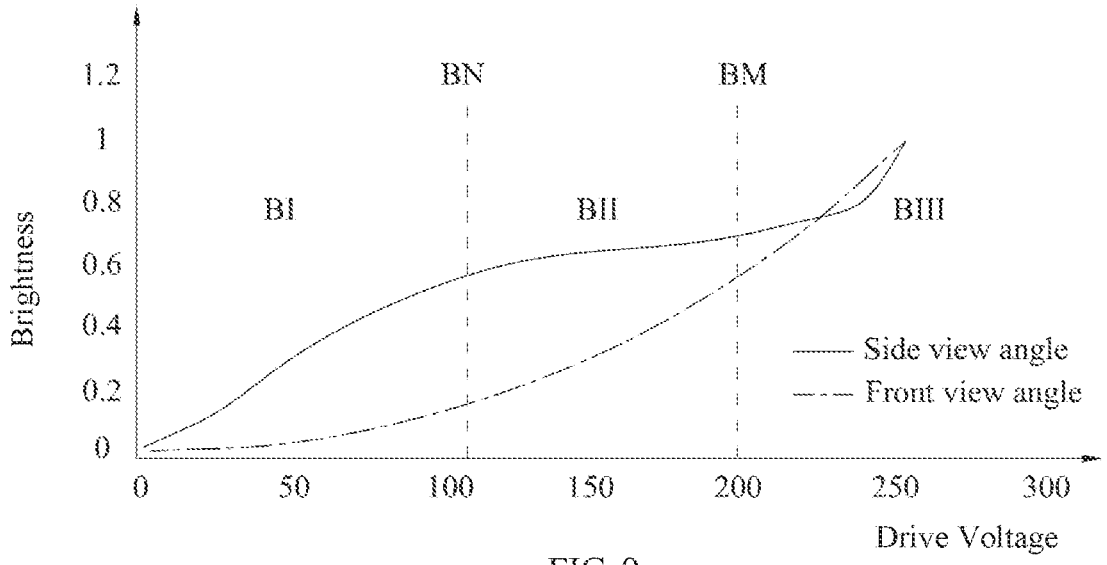
FIG. 9 shows brightness-versus-drive-signal curve of a blue sub-pixel of the display panel, in accordance with the present disclosure.

Please refer to FIGS. 7 through 9, which respectively show brightness-versus-drive-voltage curves of a red sub-pixel, a green sub-pixel and a blue sub-pixel when the display panel is viewed under front view angle and side view angle. In FIG. 7, RN and RM are first threshold and second threshold corresponding to red sub-pixel, respectively. The slopes of tangent lines of curves within the interval RI and the interval RIII both are higher than the preset slope threshold, and the slope of tangent line of the curve within the interval RII is lower than the preset slope threshold, and the brightness within the interval RII trends to saturation. In FIG. 8, GN and GM are the first threshold and the second threshold corresponding to green sub-pixel, respectively. The slopes of tangent lines of curve within the interval GI and the interval GIII are higher than the preset slope threshold, and the slope of tangent line of curve within the interval GII is lower than the preset slope threshold, and the brightness within interval GII trends to saturation. In FIG. 9, BN and BM are the first threshold and the second threshold corresponding to blue sub-pixel, respectively. The slopes of tangent lines of curve within the interval BI and the interval BIII are higher than the preset slope threshold, the slope of tangent line of curve within the interval BII is lower than preset slope threshold, and brightness within the interval BII trends to saturation.

The step S100 includes: adjusting the drive signal between the first threshold and the second threshold, to approach the interval where the drive signal is lower than the first threshold, or to the interval where the drive signal is higher than the second threshold.

In other words, when the drive signal is within the interval of the first threshold to the second threshold, the value of the drive signal is decreased to be close to the interval where the drive signal is lower than the first threshold; or the value of the drive signal is increased to be close the interval where the drive signal is higher than the second threshold. The red sub-pixel shown in FIG. 7 is taken as example for illustration again, For the drive signal within interval RII, the drive signal at a left side of the interval RII can be decreased by a preset value, so as to enter or approach the interval RI; and, the drive signal at a right side of the interval RII can be increased by a preset value, so as to enter or approach the interval RIII. As a result, after adjustment of the drive signal, the drive signals originally within the interval RII can be adjusted to enter or approach the interval RI and the interval RIII, so that the brightness-versus-drive-signal curve of the sub-pixels can vary more linearly under the side view angle. Signal processing operations performed on the green sub-pixel and the blue sub-pixel are equal to that of the red sub-pixel, so detailed description is not repeated.

Specifically, the step S100 can be implemented by following steps S110 and S120. Please refer to FIG. 3.

In step S110, the sub-pixels having the same color are separated into multiple sub-pixel sets on the display panel.

Figure 4:
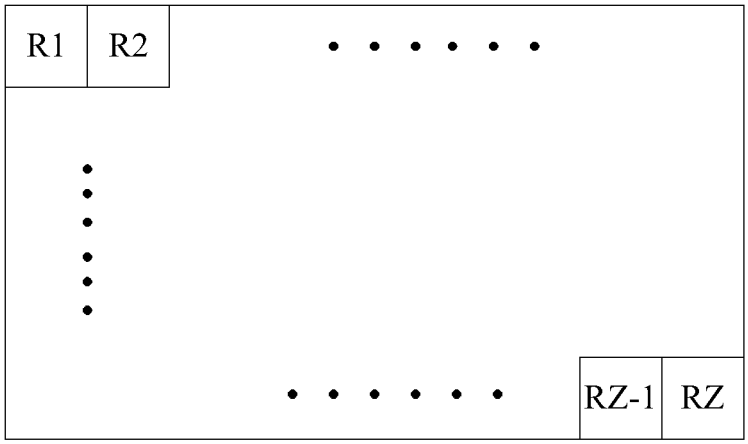
FIG. 4 is a schematic view of red sub-pixels on the display panel, in accordance with the driving method of display panel of FIG. 2.
Figure 5:
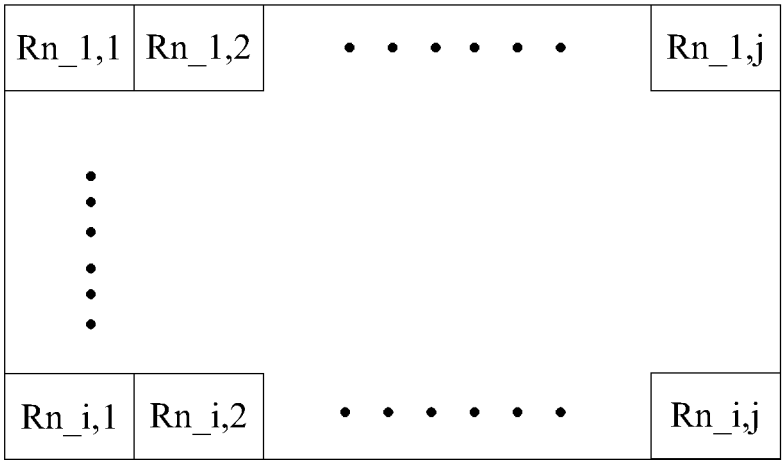
FIG. 5 is a schematic view of red sub-pixel sets on the display panel of FIG. 4.

Specifically, the red sub-pixels on the display surface can be separated into multiple red sub-pixel sets, the green sub-pixels on the display surface can be separated into multiple green sub-pixel sets, and the blue sub-pixels on the display surface can be separated into multiple blue sub-pixel sets. The red sub-pixels are taken as example for illustration. Please refer to FIG. 4. All red sub-pixels on the display panel are separated into Z red sub-pixel sets R1, R1, R2, . . . , RZ. Please refer to FIG. 5. Each red sub-pixel set includes a plurality of red sub-pixels Rn_1,1, Rn_1,2, . . . Rn_i*j.

In the step S120, the drive signals of each sub-pixel set between the first threshold and the second threshold, are adjusted to approach the interval where the drive signal is lower than the first threshold, or to the interval where the drive signal is higher than the second threshold.

The drive signals of the red sub-pixel set can be adjusted according to the first threshold RN and the second threshold RM shown in FIG. 7. The drive signals of the green sub-pixel set can be adjusted according to the first threshold GN and the second threshold GM shown in FIG. 8. The drive signal of the blue sub-pixel set can be adjusted according to the first threshold BN and the second threshold BM shown in FIG. 9.

In this embodiment, the sub-pixels of the display panel are separated into a plurality of sub-pixel sets, so the signal process can be independently performed on each sub-pixel set, thereby effectively processing the brightness property of local sub-pixels. Furthermore, when the number of sub-pixel sets of the display panel is more, precision of the signal process can be higher and the image quality of the display panel can be better. The number of the separated sub-pixel sets can be adjusted upon practical condition, so as to extend usage scope of the driving method of the present disclosure.

Specifically, the step S120 can be specifically implemented by following steps S121 and S122. Please refer to FIG. 6.

In step S121, an average drive signal of each sub-pixel set is calculated.

The average drive signal is a mean value of magnitudes of drive signals of all sub-pixels in the sub-pixel set. For example, the average drive signal of the red sub-pixel can be average_1=Ave (Rn_1,1, Rn_1,2 . . . , Rn_i*j). In each sub-pixel set, the drive signals of some sub-pixels are higher than the average drive signal, and the drive signals of other of sub-pixels are lower than the average drive signal.

In step S122, when it is determined that the average drive signal is lower than the first threshold, the drive signal higher than the average drive signal is decreased by a first preset value.

The red sub-pixel is taken as an example for illustration. Sub-pixels are arranged in a sequential order according to magnitudes of drive signal, from high to low: R1≥R2≥R3≥ . . . ≥R_i*j, wherein R1, R2, . . . , R_i*j indicate the drive signals corresponding to sub-pixels in the red sub-pixel set. Suppose that the drive signals of first k sub-pixels are higher than the average drive signal, the drive signals of k sub-pixels can be adjusted according to below equations:

$$R'1=R1-X1, R'2=R2-X1, R'k=Rk-X1,$$

wherein X1 is first preset value, and R'1, R'2, . . . , R'k are the k adjusted drive signals.

As shown in FIG. 7, when the average drive signal of the red sub-pixel set is lower than the first threshold RN, the sub-pixels of which drive signals are higher than the average drive signal have significant defect of brightness saturation under the large view angle before adjustment; that is, some sub-pixels are within the interval RII, or close to the interval RII. In this embodiment, the drive signals of these sub-pixels are decreased by the first preset value, so as to increase linear resolution of the brightness-versus-drive-signal curve of the sub-pixel under the large view angle, thereby improving contrast between brightness of these sub-pixels under the large view angle.

Specifically, the first preset value at least satisfies a condition that the maximum drive signal, in the sub-pixel set, minus the first preset value is lower than the first threshold. At this time, by adjusting the drive signal, the drive signals of all sub-pixels of the sub-pixel set can be moved to the interval RI. Furthermore, the first preset value can be adjusted according to properties of different display panels or different scenarios for the same display panel, so as to solve defect of brightness saturation.

Further, Step S120 further includes: increasing the drive signal, which is lower than the average drive signal, by a second preset value when it is determined that the average drive signal is lower than the first threshold. The second preset value is Rave_1=k*X1/(n−k), wherein Rave_1 is the second preset value, and k is number of the sub-pixels, of which the drive signals are higher than the average drive signal, in the sub-pixel set; wherein X1 is the first preset value, and n is a number of the sub-pixels of the sub-pixel set.

In the example of red sub-pixel set, the drive signals of remaining sub-pixels other than the first k red sub-pixels are respectively adjusted according to following equation:

$$R'(k+1)=R(k+1)+Rave_1, R'(k+2)=R(k+2)+Rave_1$$

$$R'(i*j)=R(i*j)+Rave_1,$$

This signal process can make brightness of whole sub-pixel set constant. Furthermore, the drive signals, lower than the average drive signal, plus the second preset value can still be located at lower positions in the interval where the drive signal is lower than the first threshold, so that curve of pixel is still linear enough under the large view angle while contrast property of the panel is not affected.

Further, the step S120 further includes: increasing the drive signal higher than the average drive signal by a third preset value when it is determined that the average drive signal is higher than the first threshold and lower than the second threshold.

The red sub-pixel is taken as an example. The sub-pixels are arranged in a sequential order according to magnitudes of drive signal, from high to low, R1≥R2≥R3≥ . . . ≥R_i*j; wherein R1, R2, . . . , R_i*j indicate drive signals corresponding to the sub-pixel in the red sub-pixel set. Suppose that the drive signals of first k sub-pixels are higher than the average drive signal, the drive signals of the k sub-pixels are adjusted according to below equations:

$$R'1=R1+X2, R'2=R2+X2, R'k=Rk+X2,$$

wherein X2 is the third preset value, and R'1, R'2, . . . , R'k are the first k adjusted drive signals, respectively.

As shown in FIG. 7, when the average drive signal is higher than the first threshold RN and lower than the second threshold RM, the sub-pixels of the red sub-pixel set, of which drive signal are higher than the average drive signal may have significant defect of brightness saturation under large view angle before adjustment; that is, some sub-pixels are within the interval MI, or close to the interval MI. In this embodiment, these drive signals of the sub-pixels are increased by the third preset value, so that the drive signals of the sub-pixels can be adjusted to enter the interval RIII, or more approach the interval RIII, and the brightness-versus-drive-signal curve under the large view angle can be more linear, thereby improving contrast between brightness of these sub-pixels under the large view angle.

Specifically, the second preset value at least satisfied a condition that the minimum drive signal of the drive signals, higher than the average drive signal, plus the third preset value can be higher than the second threshold. At this case, by adjusting the drive signals, all drive signals of the sub-pixels higher than the average drive signal, can be moved to the interval RIII Furthermore, the third preset value can be adjusted according to different properties of different display panels or different scenario for the same display panel, thereby effectively solving defect of brightness saturation.

Further, the step S120 further includes: decreasing the drive signal lower than the average drive signal by a fourth preset value when it is determined that the average drive signal is higher than the first threshold and lower than the second threshold. The fourth preset value is:

$$Rave_2=k*X2/(n-k),$$

wherein Rave_2 is the fourth preset value, and k is number of the sub-pixels, of which the drive signals higher than the average drive signal, in the sub-pixel set; wherein X2 is the third preset value; n is a number of the sub-pixels of the sub-pixel set.

In the example of the red sub-pixel set, the drive signals of remaining sub-pixels other than first k red sub-pixels are respectively adjusted according to following equation:

$$R'(k+1)=R(k+1)-Rave_2, R'(k+2)=R(k+2)-Rave_2, \ldots, R'(i*j)=R(i)-Rave_2$$

wherein R'(k+1), R'(k+2), . . . , R'(i*j) are the adjusted drive signals. This signal process can maintain brightness of whole sub-pixel set to be constant.

As shown in FIG. 7, when the average drive signal is higher than the first threshold RN and lower than the second threshold RM, each sub-pixels of the red sub-pixel set which drive signal is lower than the average drive signal may have significant defect of brightness saturation of display panel under large view angle before adjustment; that is, some sub-pixels are within the interval RII, or close to the interval RII. In this embodiment, drive signals of these sub-pixels are decreased by the fourth preset value, so that the adjusted drive signals of sub-pixels can enter the interval RI, or further approach the interval RI, so that the brightness-versus-drive-signal curve under the large view angle can be more linear, thereby improving contrast between the drive signals of the sub-pixels under the large view angle, and the brightness-versus-drive-signal curves of the sub-pixels under the large view angle becomes more linear.

Further, the step S120 further includes: decreasing the drive signal, higher than the average drive signal, by a fifth preset value when it is determined that the average drive signal is higher than the second threshold.

The red sub-pixel is taken as an example. The sub-pixels are arranged in a sequential order according to magnitudes of drive signal, from high to low: R1≥R2≥R3≥ . . . ≥R_i*j, wherein R1, R2, . . . , R_i*j indicate the drive signal corresponding to the sub-pixel in the red sub-pixel set. Suppose that the drive signals of first k sub-pixels are higher than the average drive signal, the drive signals of the first k sub-pixels are adjusted according to below equations:

$$R'1=R1-X3, R'2=R2-X3, R'k=Rk-X3,$$

wherein X3 is the fifth preset value; wherein R'1, R'2, R'k are the first k adjusted drive signals.

As shown in FIG. 7, when the average drive signal is higher than the second threshold RM, the drive signals of the sub-pixels of the red sub-pixel set, higher than the average drive signal, minus the fifth preset value can still be within the interval of high drive signal and have more linear variation tendency of brightness, so that the brightness-versus-drive-signal curve of these sub-pixels under the large view angle can have better linear resolution, thereby improving contrast between brightness of these sub-pixels under the large view angle.

Further, the step S120 further includes: increasing the drive signal, lower than the average drive signal, by a sixth preset value when it is determined that the average drive signal is higher than the second threshold. The sixth preset value is:

$$Rave_3=k*X3/(n-k)$$

wherein Rave_3 is the sixth preset value; k is a number of the sub-pixels, of which drive signals are higher than the average drive signal, in the sub-pixel set; X3 is the fifth preset value, and n is a number of the sub-pixels of the sub-pixel set.

In the example of the red sub-pixel set, the drive signals of remaining sub-pixels other than the first k red sub-pixels can be respectively adjusted according to following equations:

$$R'(k+1)=R(k+1)+Rave_3, R'(k+2)=R(k+2)+Rave_3, R'(i*j)=R(i*j)+Rave_3,$$

wherein R'(k+1), R'(k+2), R'(i*j) are the adjusted drive signals. This signal process can maintain brightness of whole sub-pixel set to be constant. Furthermore, the drive signals, lower than the average drive signal, plus the sixth preset value can still be within the interval RIII, or at relative higher positions of the interval (such as the interval RII) between the first threshold and the second threshold, so as to ensure linearity of the brightness-versus-drive signal under the large view angle, thereby improving contrast between brightness of these sub-pixels under the large view angle.

Figure 3:
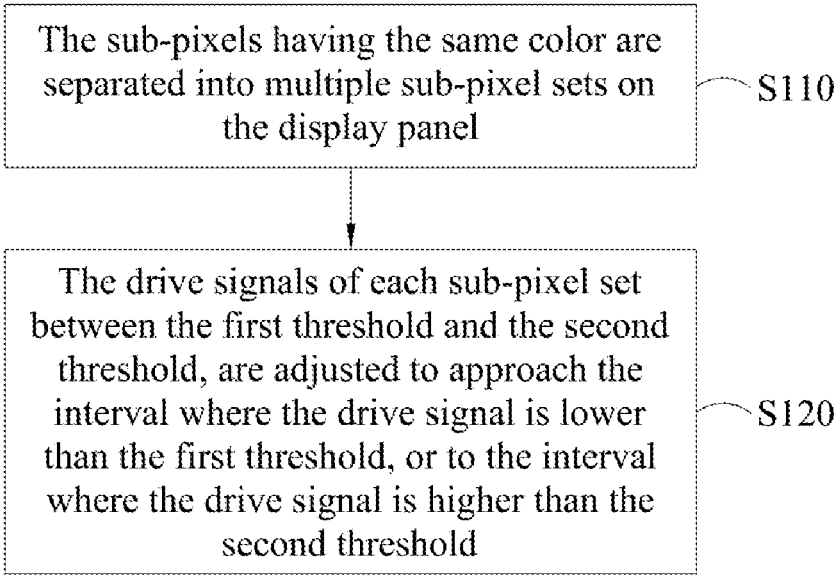
FIG. 3 is a flowchart showing an operation of an embodiment of step S100 of the driving method of the display panel of FIG. 2.
Figure 6:
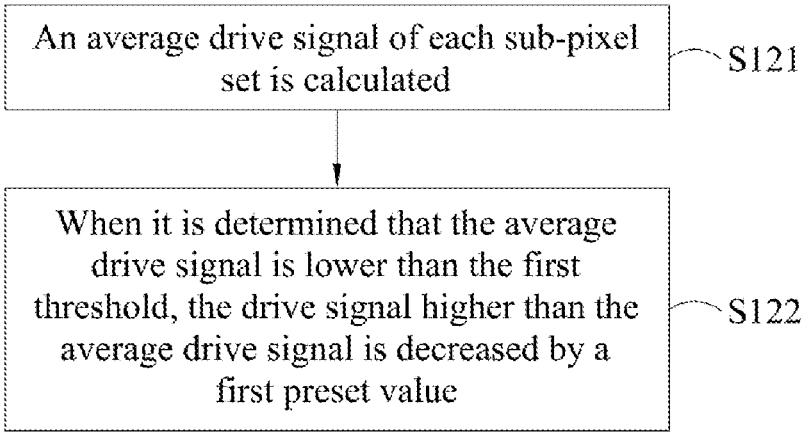
FIG. 6 is a flowchart showing an operation of an embodiment of step S120 of FIG. 3.

FIGS. 2, 3 and 6 are flow charts of the driving method of the embodiment of the present disclosure. It is to be noted that steps in a flowchart showing in FIGS. 2, 3 and 6 are displayed with arrowhead indication, but it is not necessary to execute these steps in the sequential order indicated by arrowhead, that is, execution order of these steps are not limited, unless the context clearly indicates otherwise. These steps can be executed in other sequential order. Furthermore, at least a part of steps of FIGS. 2, 3, and 6 can include a plurality of sub-steps or stages, and it is not necessary to execute and complete sub-steps or stages at the same time. These steps can be executed at different times, and the steps is not necessary to be executed step by step, other steps or s at least a part of sub-steps or stages of other steps can be executed sequentially or alternatively.

Figure 10:
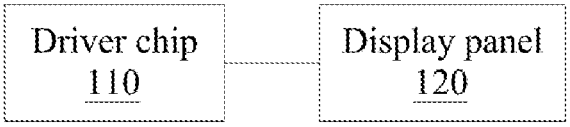
FIG. 10 is a block diagram of a display device of other embodiment of the present disclosure.

The other embodiment provides a display device, Please refer to FIG. 10. The display device includes a driver chip and a display panel. The driver chip is configured to adjust magnitudes of drive signals of sub-pixels on the display panel 120 such that the magnitude of the adjusted drive signals gets closer to the preset interval, and then use the adjusted drive signals to drive the sub-pixels on the display panel 120. Within the preset interval, the slope of each tangent line on the curve defining variation of luminance with respect to the drive signal is higher than the preset slope threshold.

In an embodiment, within luminance-versus-signal curve under the side view angle of the display panel 120, when drive signal is lower than the first threshold, higher than the second threshold, or between the first threshold and the second threshold respectively, the slope of the tangent line is higher than the preset slope threshold, higher than the preset slope threshold, or lower than the preset slope threshold.

The driver chip 110 is configured to adjust the drive signal, which is higher than the first threshold and lower than the second threshold, to be close to the interval where the drive signal is lower than the first threshold, or the interval where the drive signal is higher than the second threshold.

In an embodiment, the driver chip 110 is configured to separate the sub-pixels having the same color into the multiple sub-pixel sets on the display panel 120, and adjust the drive signals of each sub-pixel set which is higher than the first threshold and lower than the second threshold, to be close to the interval where the drive signal is lower than the first threshold, or the interval where the drive signal is higher than the second threshold.

In an embodiment, the driver chip 110 is configured to calculate the average drive signal of each sub-pixel set. When the driver chip 110 determines that the average drive signal is lower than the first threshold, the driver chip 110 decreases the drive signal, higher than the average drive signal, by the first preset value.

In an embodiment, first preset value satisfies a condition that the maximum drive signal of the sub-pixel set minus the first preset value can be lower than the first threshold.

In an embodiment, when the driver chip 110 determines that the average drive signal is lower than the first threshold, the driver chip 110 increases the drive signal, lower than average drive signal, by the second preset value. The second preset value is:

$$Rave_1=k*X1/(n-k),$$

wherein Rave_1 is the second preset value; wherein k is number of the sub-pixels, of which drive signals are higher than the average drive signal, in the sub-pixel set; wherein X1 is the first preset value; n is a number of the sub-pixels of the sub-pixel set.

In an embodiment, when the driver chip 110 determines that the average drive signal is higher than the first threshold and lower than the second threshold, the driver chip 110 increases the drive signal, higher than the average drive signal, by the third preset value.

In an embodiment, when the driver chip 110 determines that the average drive signal is higher than the first threshold and lower than the second threshold, the driver chip 110 decreases the drive signal lower than the average drive signal by the fourth preset value. The fourth preset value is:

$$Rave_2=k*X2/(n-k),$$

wherein Rave_2 is the fourth preset value; k is number of the sub-pixels, of which drive signals are higher than the average drive signal, in the sub-pixel set; X2 is the third preset value; n is a number of the sub-pixels of the sub-pixel set.

In an embodiment, when the driver chip 110 determines that the average drive signal is higher than the second threshold, the driver chip 110 decreases the drive signal, higher than the average drive signal, by the fifth preset value.

It is to be noted that, the function of the driver chip 110 of the display device provided in this embodiment can be performed according to the principle the same as that of driving method of display panel of other embodiment, so detailed description is not repeated.

Preferably, the display device can be LCD display device, OLED display device, LED display device, curved display device or the like.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A driving method of a display panel, comprising:

adjusting a magnitude of a drive signal of each sub-pixels on the display panel such that the magnitude of the adjusted drive signals gets closer to a preset interval, wherein within the preset interval, slope of each tangent lines on a curve defining variation of luminance with respect to the drive signal is higher than a preset slope threshold; and using the adjusted drive signals to drive corresponding ones of the sub-pixels, wherein according to the curve defining variation of luminance with respect to the drive signal under a side view angle of the display panel, when the drive signal is lower than a first threshold, higher than a second threshold, or between the first threshold and the second threshold, respectively, the slope of tangent line on the curve defining variation of luminance with respect to the drive signal is higher than a preset slope threshold, higher than the preset slope threshold, or lower than the preset slope threshold; and wherein the step of adjusting the magnitude of the drive signal of the sub-pixel on the display panel to make the adjusted drive signals close to the preset interval, further comprises:

adjusting the drive signal between first threshold and second threshold, to approach an interval where the drive signal is lower than the first threshold, or to an interval where the drive signal is higher than the second threshold.

2. The driving method according to claim 1, wherein the step of adjusting the drive signal between first threshold and second threshold, to approach the interval where the drive signal is lower than the first threshold, or the interval where the drive signal is higher than the second threshold, further comprises:

separating the sub-pixels having the same color into multiple sub-pixel sets on the display panel; and adjusting the drive signals of each sub-pixel set between the first threshold and the second threshold, to approach the interval where the drive signal is lower than the first threshold, or to the interval where the drive signal is higher than the second threshold.

3. The driving method according to claim 2, wherein the step of adjusting the drive signal of each sub-pixel set between the first threshold and the second threshold, to approach the interval where the drive signal is lower than the first threshold, or to the interval where the drive signal is higher than the second threshold, further comprises:

calculating an average drive signal of each sub-pixel set; and decreasing the drive signal, which is higher than the average drive signal, by a first preset value when it is determined that the average drive signal is lower than the first threshold.

4. The driving method according to claim 3, wherein the first preset value satisfies a condition that a value of maximum drive signal in the sub-pixel set minus the first preset value is lower than first threshold.

5. The driving method according to claim 3, wherein the step of adjusting the drive signal of each sub-pixel set between the first threshold and the second threshold to approach the interval where the drive signal is lower than the first threshold, or to the interval where the drive signal is higher than the second threshold, further comprises:

when it is determined that average drive signal is lower than the first threshold, increasing the drive signal, which is lower than the average drive signal, by a second preset value;

wherein the second preset value is defined by following equation:

$$Rave_1=k*X1/(n-k)$$

wherein Rave_1 is second preset value; wherein k is a number of the sub-pixels, of which drive signal are higher than the average drive signal, in sub-pixel set; wherein X1 is the first preset value; wherein n is a number of the sub-pixels of the sub-pixel set.

6. The driving method according to claim 3, wherein the step of adjusting the drive signals of each sub-pixel set between the first threshold and the second threshold, to approach the interval where the drive signal is lower than the first threshold, or to the interval where the drive signal is higher than the second threshold, further comprises:

increasing the drive signal, which is higher than the average drive signal, by a third preset value when it is determined that the average drive signal is higher than the first threshold and lower than the second threshold.

7. The driving method according to claim 6, wherein the step of adjusting the drive signals of each sub-pixel set between the first threshold and the second threshold, to approach the interval where the drive signal is lower than the first threshold, or to the interval where the drive signal is higher than the second threshold, further comprises:

when it is determined that the average drive signal is higher than the first threshold and lower than the second threshold, decreasing the drive signal lower than average drive signal by a fourth preset value;

wherein the fourth preset value is defined by following equation:

$$Rave_2=k*X2/(n-k)$$

wherein Rave_2 is the fourth preset value; wherein k is a number of the sub-pixels, of which drive signals are higher than the average drive signal, in the sub-pixel set; wherein X2 is the third preset value; wherein n is a number of the sub-pixels of the sub-pixel set.

8. The driving method according to claim 3, wherein the step of adjusting the drive signal between the first threshold and the second threshold, to approach the interval where the drive signal is lower than the first threshold, or to the interval where the drive signal is higher than the second threshold, further comprises:

when it is determined that the average drive signal is higher than the second threshold, decreasing the drive signal, which is higher than the average drive signal, by a fifth preset value.

9. The driving method according to claim 8, wherein the step of adjusting the drive signals of each sub-pixel set between the first threshold and the second threshold, to approach the interval where the drive signal is lower than the first threshold, or to the interval where the drive signal is higher than the second threshold, further comprises:

when it is determined that the average drive signal is higher than the second threshold, increasing the drive signal, which is lower than the average drive signal, by a sixth preset value;

wherein the sixth preset value is defined by following equation:

$$Rave_3=k*X3/(n-k),$$

wherein Rave_3 is the sixth preset value; wherein k is number of the sub-pixel, of which the drive signal is higher than the average drive signal, in the sub-pixel set; wherein X3 is the fifth preset value; n is a number of the sub-pixels of the sub-pixel set.

10. A display device, comprising:

a display panel; and a driver chip configured to adjust a magnitude of a drive signal of each of sub-pixels on the display panel such that the magnitude of the adjusted drive signals gets closer to a preset interval, and use the adjusted drive signals to drive the sub-pixels on the display panel;

wherein within the preset interval, a slope of each of tangent lines on a curve defining variation of luminance with respect to the drive signal is higher than a preset slope threshold, wherein on the curve defining variation of luminance with respect to the drive signal under a side view angle of the display panel, when the drive signal is lower than a first threshold, higher than a second threshold, or between the first threshold and the second threshold, respectively, the slope of the tangent line is higher than the preset slope threshold, higher than the preset slope threshold, or lower than the preset slope threshold;

wherein the driver chip adjusts the drive signal, which is higher than the first threshold and lower than the second threshold, to be close to an interval where the drive signal is lower than the first threshold, or an interval where the drive signal is higher than the second threshold.

11. The display device according to claim 10, wherein the driver chip is configured to separate the sub-pixels having the same color into multiple sub-pixel sets on the display panel, and the driver chip adjusts the drive signals of each sub-pixel set between the first threshold and the second threshold, to approach the interval where the drive signal is lower than the first threshold, or to the interval where the drive signal is higher than the second threshold.

12. The display device according to claim 11, wherein the driver chip calculates an average drive signal of each sub-pixel set, and when the driver chip determines that the average drive signal is lower than the first threshold, the drive chip decreases the drive signal higher than the average drive signal by a first preset value.

13. The display device according to claim 12, wherein the first preset value satisfies a condition that a value of maximum drive signal in the sub-pixel set minus the first preset value is lower than the first threshold.

14. The display device according to claim 12, wherein when the driver chip determines that the average drive signal is lower than the first threshold, increasing the drive signal lower than the average drive signal by a second preset value;

wherein the second preset value is defined by following equation:

$$Rave_1=k*X1/(n-k),$$

wherein Rave_1 is the second preset value; k is number of the sub-pixel, of which the drive signal is higher than the average drive signal, in the sub-pixel set; wherein X1 is the first preset value, and n is a number of the sub-pixels of the sub-pixel set.

15. The display device according to claim 12, wherein when the driver chip determines that the average drive signal is higher than the first threshold and lower than the second threshold, increasing the drive signal higher than the average drive signal by a third preset value.

16. The display device according to claim 15, wherein when the driver chip determines that the average drive signal is higher than the first threshold and lower than the second threshold, decreasing the drive signal lower than the average drive signal by a fourth preset value;

wherein the fourth preset value is defined by following equation:

$$Rave_2=k*X2/(n-k)$$

wherein Rave_2 is the fourth preset value; k is a number of the sub-pixels, of which the drive signals are higher than the average drive signal, in the sub-pixel set, and X2 is the third preset value, and n is a number of the sub-pixels of the sub-pixel set.

17. The display device according to claim 12, wherein when the driver chip determines that the average drive signal is higher than the second threshold, decreasing the drive signal higher than the average drive signal by a fifth preset value.

18. A driving method of a display panel, wherein when the drive signal is lower than the first threshold, higher than the second threshold, or between the first threshold and the second threshold, respectively, a slope of each of tangent lines on a luminance-versus-drive-signal curve under a side view angle of the display panel, is higher than a preset slope threshold, higher than the preset slope threshold, or lower than the preset slope threshold, and the driving method comprises:

separating the sub-pixels having the same color into multiple sub-pixel sets on the display panel;

calculating an average drive signal of each of the sub-pixel sets;

when it is determined that the average drive signal is lower than the first threshold, decreasing the drive signal, higher than the average drive signal, by a first preset value;

when it is determined that the average drive signal is higher than the first threshold and lower than the second threshold, increasing the drive signal, higher than the average drive signal, by a third preset value;

decreasing the drive signal, higher than the average drive signal, by a fifth preset value, when it is determined that the average drive signal is higher than the second threshold; and using the adjusted drive signals to drive corresponding one of the sub-pixels.

* * * * *